US011633656B2

(12) United States Patent
Walker

(10) Patent No.: US 11,633,656 B2
(45) Date of Patent: Apr. 25, 2023

(54) SYSTEM AND METHOD FOR A GOLF PUTTING TRAINING AID APPARATUS

(71) Applicant: Andres Walker, Palm Beach, FL (US)

(72) Inventor: Andres Walker, Palm Beach, FL (US)

(73) Assignee: Dubline Golf, LLC, West Palm Beach, FL (US)

( * ) Notice: Subject to any disclaimer, the term of this patent is extended or adjusted under 35 U.S.C. 154(b) by 0 days.

(21) Appl. No.: 17/517,600

(22) Filed: Nov. 2, 2021

(65) Prior Publication Data

US 2022/0134207 A1 May 5, 2022

Related U.S. Application Data

(60) Provisional application No. 63/108,828, filed on Nov. 2, 2020.

(51) Int. Cl.
*A63B 69/36* (2006.01)
*A63B 71/06* (2006.01)

(52) U.S. Cl.
CPC ..... *A63B 69/3676* (2013.01); *A63B 69/3621* (2020.08); *A63B 71/06* (2013.01); *A63B 2071/0694* (2013.01)

(58) Field of Classification Search
CPC . A63B 69/3676; A63B 69/3621; A63B 71/06; A63B 2071/0694; A63B 2214/00
USPC ..... 473/257, 258, 261, 262, 265, 409
See application file for complete search history.

(56) References Cited

U.S. PATENT DOCUMENTS

| | | | | |
|---|---|---|---|---|
| 3,806,133 | A * | 4/1974 | Cork | A63B 69/3676 473/258 |
| 5,913,732 | A * | 6/1999 | Kwakkel | A63B 69/3676 473/409 |
| 6,048,273 | A * | 4/2000 | Clement | A63B 69/3676 273/DIG. 21 |
| 6,458,041 | B1 * | 10/2002 | Brandt | A63B 69/3682 473/268 |
| 6,695,710 | B2 * | 2/2004 | Yamada | A63B 69/3621 473/265 |
| 6,755,751 | B2 * | 6/2004 | Chapman | A63B 69/3667 473/258 |
| 2004/0192457 | A1 * | 9/2004 | Tai | A63B 69/3682 473/195 |

* cited by examiner

*Primary Examiner* — Nini F Legesse
(74) *Attorney, Agent, or Firm* — Polsinelli PC

(57) ABSTRACT

Various embodiments for a golf putting training aid having a first stake coupled to a second stake by an upper alignment string and a lower alignment string that collectively establish parallel reference putting lines when the first and second stakes are deployed around a putting surface to train a golfer to properly align their eyes when executing a putt are disclosed.

7 Claims, 8 Drawing Sheets

SYSTEM AND METHOD FOR A GOLF PUTTING TRAINING AID APPARATUS

CROSS REFERENCE TO RELATED APPLICATIONS

This non-provisional application that claims benefit to U.S. Provisional Patent Application Ser. No. 63/108,828 filed 2 Nov. 2020, which is herein incorporated by reference in its entirety.

FIELD

The present disclosure generally relates to golf training aids, and in particular to systems and methods for a golf putting training aid apparatus that trains golfers to properly align their eyes either inside or directly above a golf ball by establishing parallel reference lines that provide a visual cue to the golfer as to the present alignment of their eyes at address when putting.

BACKGROUND

In golf, good putting requires consistent and correct alignment of the golfer's eyes relative to the golf ball so that the golfer can properly align their putter in a perpendicular orientation relative to the golf ball and the putting line. This requires the golfer to consistently align their eyes either just inside or directly on top of the golf ball relative to the putting line; however, many golfers will improperly align their eyes outside the golf ball (e.g. the area on the opposite side of the golf ball relative to the golfer) which results in the golfer misaligning their putter relative to the putting resulting in missed putts. Although many golf putting aids may provide effective training aids for executing putts, there aren't any golf putting aids that train the golfer to consistently and correctly align their eyes when executing a putt.

It is with these observations in mind, among others, that various aspects of the present disclosure were conceived and developed.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
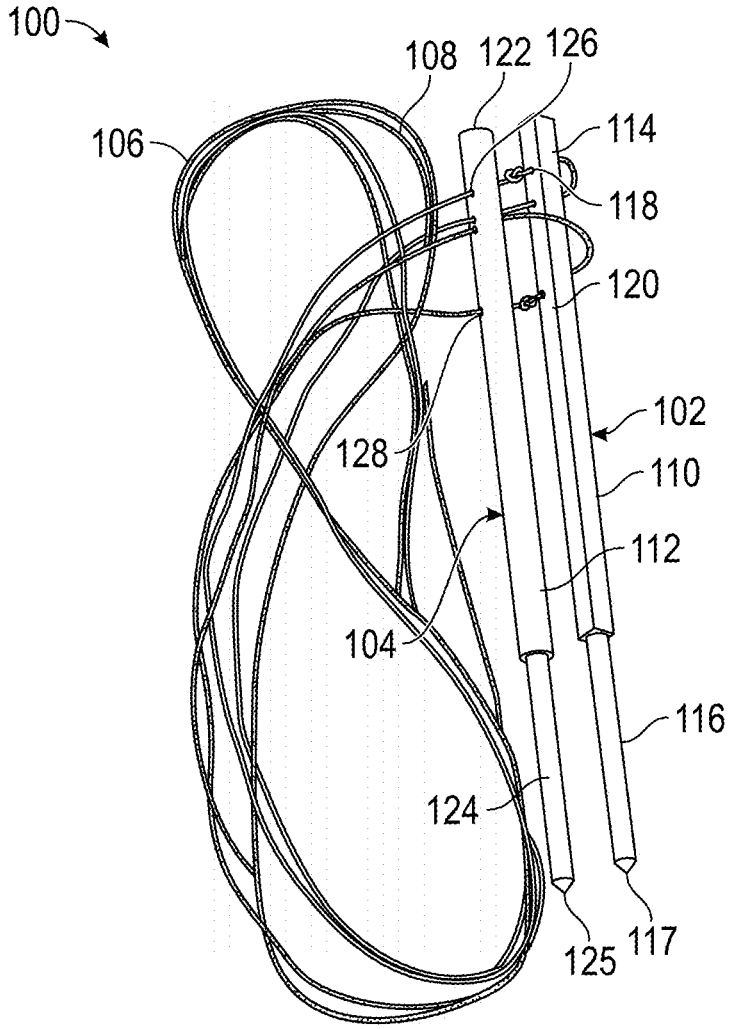
FIG. 1 is a perspective view of a golf putting aid apparatus including first and second stakes each secured to an upper alignment string and a lower alignment string in a disassembled state prior to deployment on a putting surface.

Various embodiments of a golf putting aid apparatus for establishing parallel reference lines that provide a visual cue for training a golfer to consistently and correctly align their eyes either just inside or directly on top of a golf ball when executing a putt along a putting surface are disclosed herein. In some embodiments, the golf putting aid apparatus includes a first stake coupled to a second stake by upper and lower alignment strings that establish parallel reference lines for the golfer to properly align their eyes. To deploy the golf putting aid apparatus, the first and second stakes are embedded along a putting surface at two different positions such that the upper and lower alignment strings become taunt and are strung tightly between the first and second stakes in parallel relation to each other along a vertical plane. Once the first and second stakes are deployed, the golfer aligns their body in parallel to the upper and lower alignments strings in which a golf ball is positioned directly below and then the golfer aligns their eyes either just inside or directly on top of a golf ball positioned directly beneath the upper and lower alignment strings as the golfer assumes a proper putting position. In one aspect, a golfer that properly aligns their eyes directly above the golf ball will perceive only the upper alignment string which blocks the view of the lower alignment string, thereby providing a visual cue to the golfer of their proper eye alignment relative to the golf ball. In another aspect, a golfer that properly aligns their eyes just inside the golf ball will visually perceive a slight separation or distance between the upper and lower alignment strings in which the lower alignment string is perceived to be aligned left of the upper alignment string, thereby providing the golfer with a visual cue that their eyes are properly aligned relative to the golf ball when executing putts. Referring to the drawings, an embodiment of a golf putting aid apparatus is illustrated and generally indicated as 100.

Figure 2:
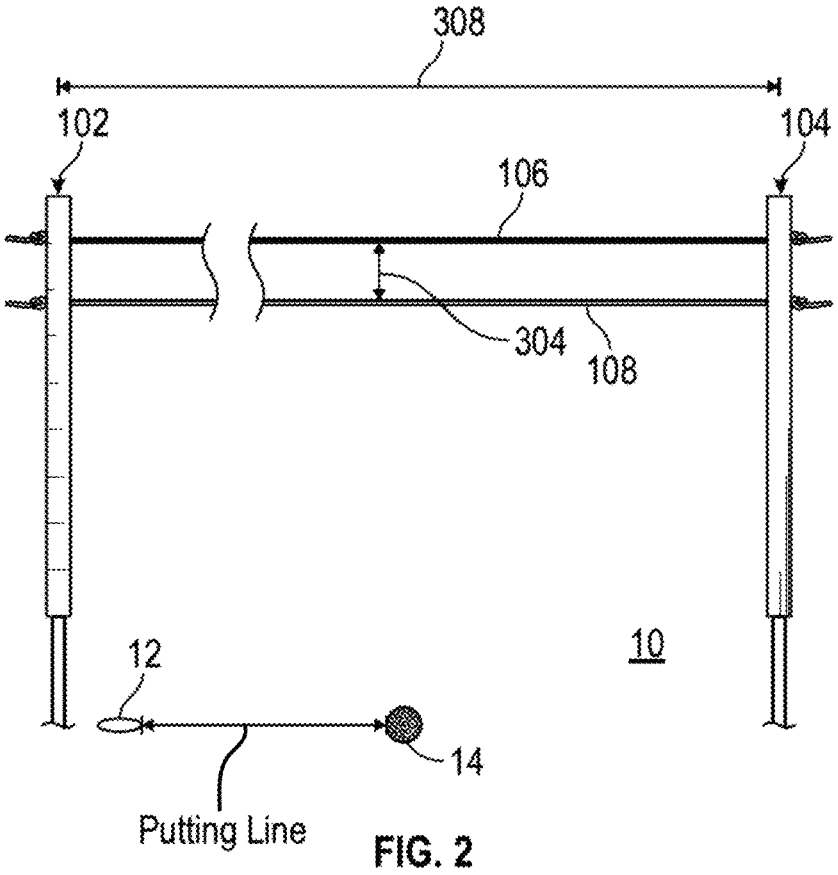
FIG. 2 is a side view of the golf putting aid apparatus showing the upper and lower alignment strings in parallel relation to each other when deployed along a putting surface.
Figure 4:
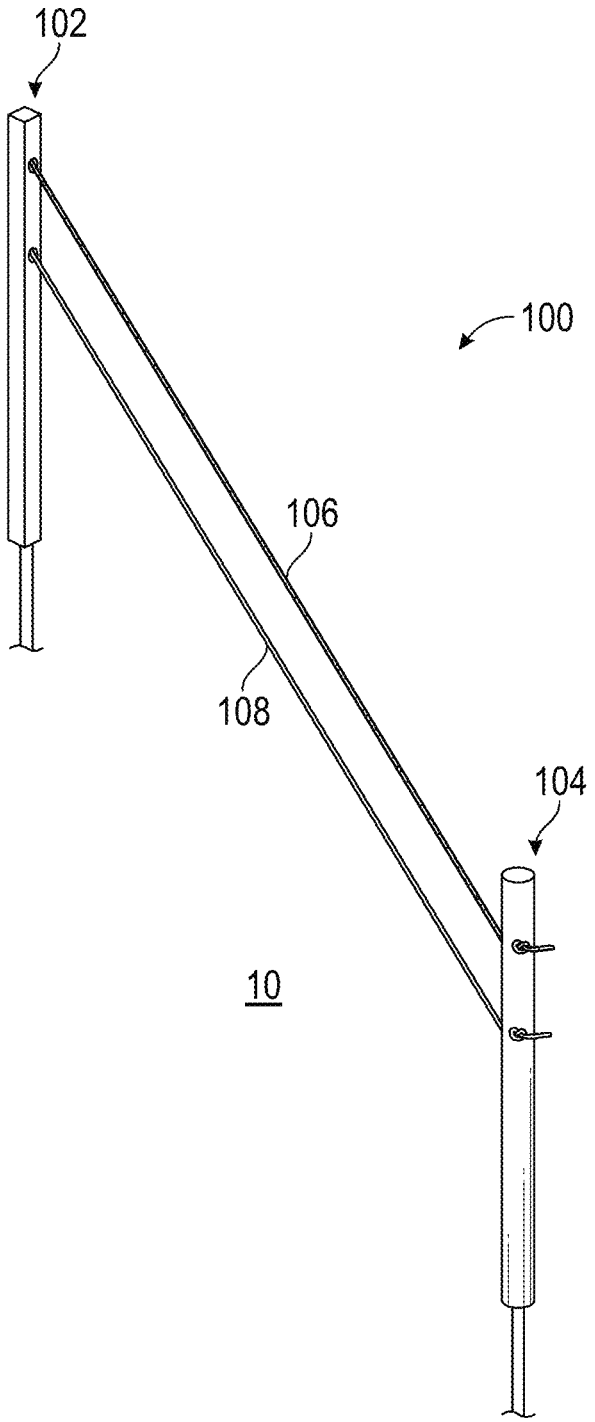
FIG. 4 is a perspective view of the golf putting aid apparatus showing the first stake embedded in a putting surface in the foreground proximate the hole and the second stake embedded in the putting surface in the background such that the upper and lower alignment strings are strung in parallel relative to each other between the first and second stakes.
Figure 5A:
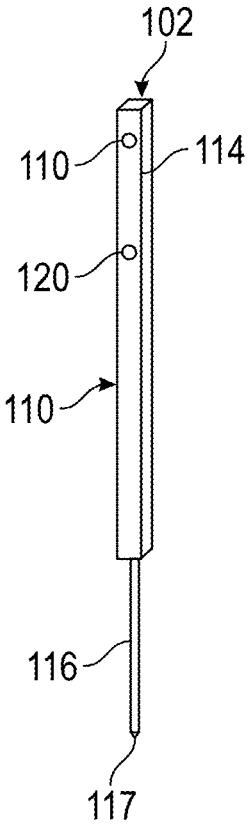
FIG. 5A is a side view of the first stake of FIG. 1 showing the first and second apertures configured for coupling the respective upper and lower alignment strings.
Figure 5B:
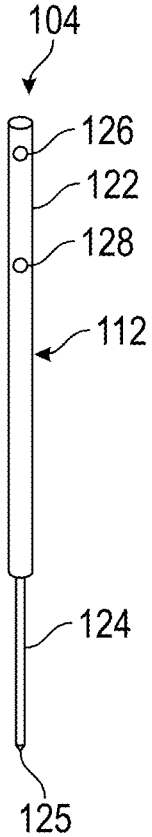
FIG. 5B is a side view of the second stake of FIG. 1 showing the first and second apertures configured to coupling the respective opposite ends of the upper and lower alignment strings.

Referring to FIG. 1, one embodiment of the golf putting aid apparatus 100 may include a first stake 102 that is tethered to a second stake 104 by upper and lower alignment strings 106 and 108 after deployment on a putting surface 10. After the first and second stakes 102 and 104 are deployed along the putting surface 10 dual reference lines are established to provide a visual cue to the golfer. For example, the golf putting aid apparatus may be deployed by embedding the first stake 102 along the putting surface 10 at a first position and then embedding the second stake 104 along the putting surface 10 at a second position such that the upper and lower alignment strings 106 and 108 assume a tightened or taunt state in parallel relation to each other between the first and second stakes 102 and 104 as illustrated in FIG. 2. In one arrangement as shown in FIG. 4, the first stake 102 at the first position may be located proximate a hole 12 formed in the putting surface 10 such that the upper and lower alignment strings 106 and 108 extend over the hole 12 to the second stake 104 at the second position to provide visual parallel reference lines to the golfer's eyes that extend between golf ball 14 and the hole 12 by the upper and lower alignment strings 106 and 108. In some embodiments, the upper and lower strings 106 and 108 have contrasting colors and/or finishes that provides the golfer with a visual cue to properly align their eyes relative to the golf ball 14, whether directly above or just inside the golf ball 14. For example, the upper alignment string 106 may be a dark color and the lower alignment string 106 may be a light color, or vice versa, that provides a visual contrast to the golfer's eyes between the upper and lower alignment strings 106 and 108.

Figure 3:
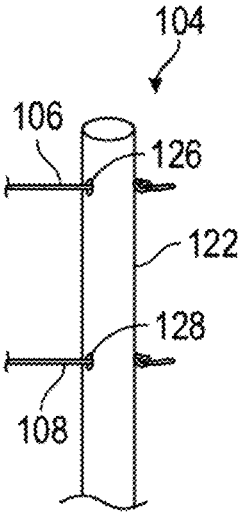
FIG. 3 is an enlarged view of the second stake of FIG. 2 showing the upper and lower alignment strings secured to respective apertures formed through the second stake.

In some embodiments the first and second stakes 102 and 104 may be identical in shape and construction, although in other embodiments the proximal end portion 114 of the first stake 102 and the proximal end portion 122 of the second stake 104 may have different shapes, configurations, color, and/or construction. For example, in some embodiments, the proximal end portion 114 of the first stake 102 may have a circular cross-section and the proximal end portion 122 of the second stake 104 may have a square cross-section as shown in FIGS. 1 and 3; however, both first and second stakes 102 and 104 may have the same circular cross-section or a square cross section. In some embodiments, the first stake 102 has an elongated shaft body 110 defining a proximal end portion 114 and an opposite distal end portion 116 forming a pointed end 117 configured to allow the first stake 102 to be embedded into a putting surface or other suitable surface area for putting a golf ball 14. In addition, first and second apertures 118 and 120 are formed through the elongated body 110 and are configured to receive and secure respective end portions 130 and 132 of the upper and lower alignment strings 106 and 108 to the first stake 102. Similarly, the second stake 104 has an identically configured elongated shaft body 112 defining a proximal end portion 122 and an opposite distal end portion 124 forming a pointed end 125 configured to allow the second stake 104 to be embedded into a putting surface. In addition, first and second apertures 126 and 128 are formed through the elongated body 112 and are configured to receive and secure respective opposite end portions 134 and 136 of the upper and lower alignment strings 106 and 108 to the second stake 104.

Figure 6:
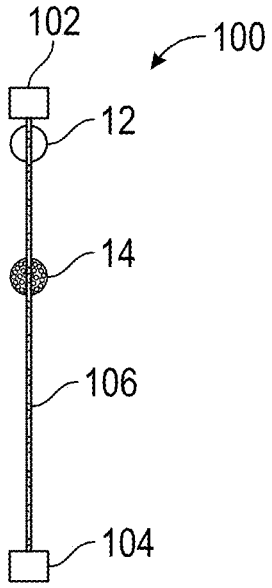
FIG. 6 is a top view of the golf putting aid apparatus deployed on a putting surface illustrating when a golfer has their eyes properly aligned directly over the golf ball such that the upper alignment string completes completely covers the lower alignment string.

In one method of deploying and using the golf putting aid apparatus 100, a golfer embeds the first and second stakes 102 and 104 at two respective positions along a putting surface 10 such that the upper and lower alignment strings 106 and 108 are separated by a distance 308 and assume a taunt state such that the upper and lower alignment strings 106 and 108 are in parallel relation to each other between the first and second stakes 102 and 104 as shown in FIG. 2. Once the golf putting aid apparatus 100 is deployed, the upper and lower alignment strings 106 and 108 establish parallel reference lines for the golfer to visually align their eyes as shall be discussed in greater detail below. As shown in FIGS. 2 and 6, the golfer first aligns their feet, shoulders, and forearms parallel to the direction of the upper alignment string 106 with the golf ball 14 positioned directly below the upper and lower alignment strings 106 and 108. As shown in FIG. 2, the upper and lower alignment strings 106 and 108 may be separated a distance 304, such as six inches, which is equal to the distance that separates the respective first and second apertures 118, 120, 126 and 128 formed along first and second stakes 102 and 104, although the distance 304 may range between ½ inch to 12 inches.

Figure 7:
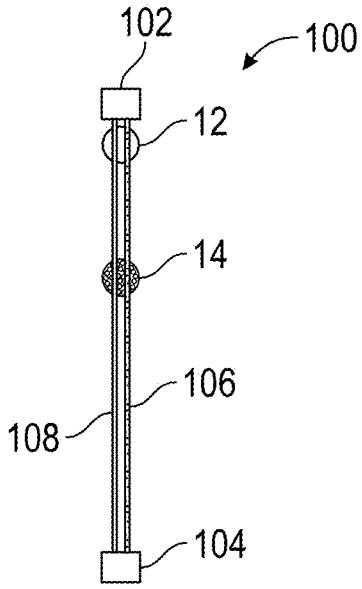
FIG. 7 is a top view of the golf putting aid apparatus deployed on putting surface illustrating when a golfer has their eyes improperly aligned inside the golf ball such that a gap appears between the upper alignment string and the lower alignment string.
Figure 13:
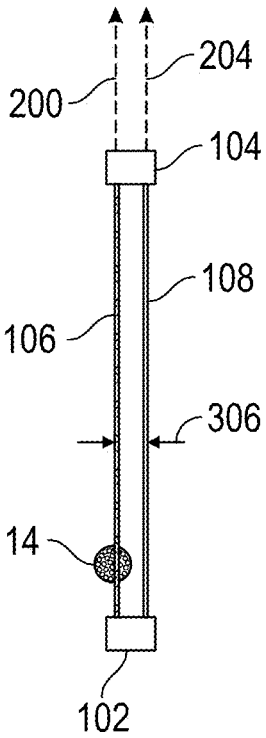
FIG. 13 is an illustration that shows the visual alignment of the upper and lower alignment strings when a golfer improperly aligns their eyes outside the golf ball such that the golfer perceives the lower alignment string being aligned to the right of the upper alignment string by a perceived separated distance.
Figure 15:
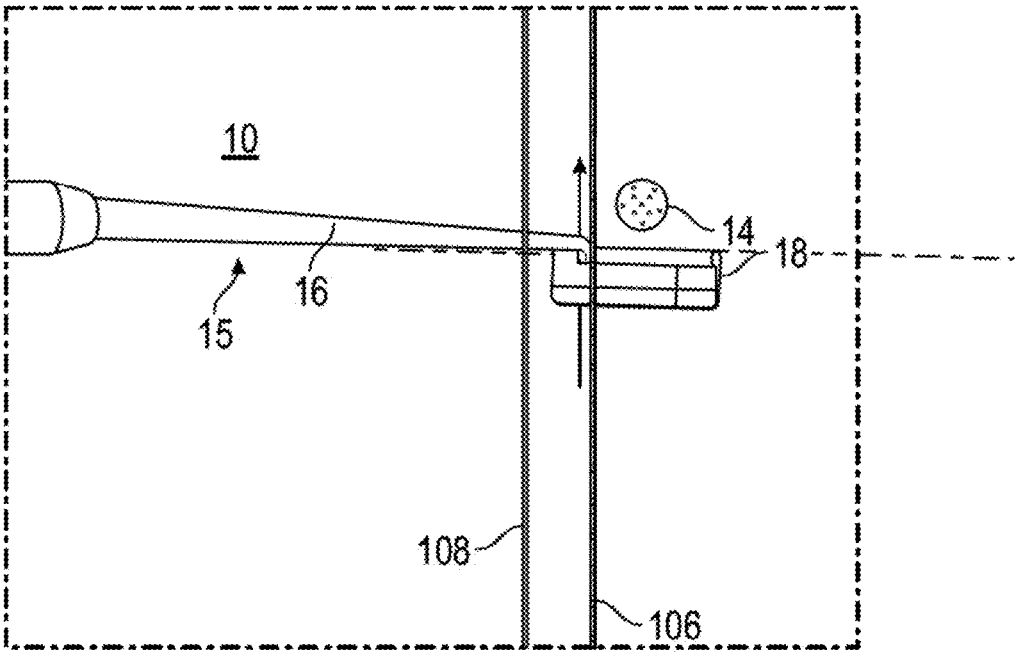
FIG. 15 is an enlarged view of the putter within the pathway defined by the upper and lower alignment strings for maintaining the putter shaft moving back and forth along a single plane.

Referring to FIGS. 7 and 13, the golfer can train their eyes to be directly above the golf ball 14 consistently by aligning their eyes directly above the golf ball 14 until the upper alignment string 106, which is oriented along axis 200, is perceived by the golfer to block the view of the lower alignment string 108, thereby providing a visual cue to the golfer that their eyes are aligned directly above the golf ball 14. In this manner, the golfer can properly and consistently align their putter in perpendicular relation to the putting line. For example, when the golfer properly aligns their eyes directly above the upper alignment string 106, the upper alignment string 106 provides a visual cue regarding the alignment of their putter. For example, as shown in FIG. 15, the upper alignment string 106 provides a visual reference line that allows the golfer to properly align their putter such that the face of the putter is oriented in perpendicular relation relative to the upper alignment string 106 when the golfer's eyes are properly aligned directly above the upper and lower alignment strings 106 and 108. FIG. 16 shows an image of when the putter is improperly oriented too far left relative to the upper alignment string 106, while FIG. 17 shows an image of when the putter is improperly oriented too far right relative to the upper alignment string 106 when the golfer's eyes are aligned directly above the upper and lower alignment strings 106 and 108 so that only the upper alignment string 106 is visible to the golfer.

Figure 8:
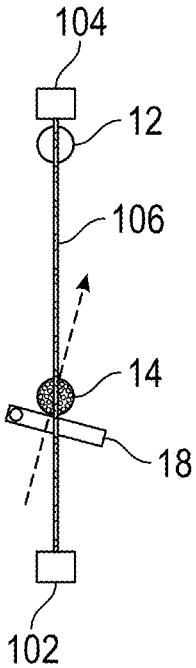
FIG. 8 is an illustration showing the putter oriented to the right of target at address relative to the putting line established by the aligned upper and lower alignment strings in which the upper alignment string covers the lower alignment string.
Figure 12:
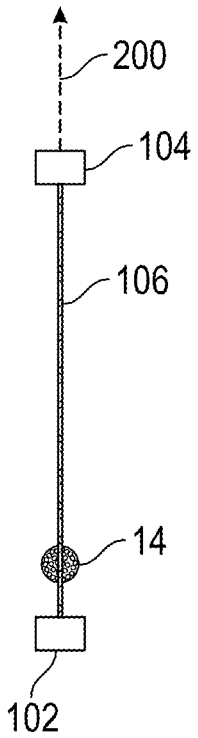
FIG. 12 is an illustration that shows the visual alignment of the upper and lower alignment strings when a golfer properly aligns their eyes directly above the golf ball such that the golfer visually perceives only the upper alignment string while the lower alignment string is perceived to be hidden by the upper alignment string.

Referring to FIGS. 8 and 12, the golfer may also train their eyes to be oriented consistently inside the golf ball 14 (e.g., the side of the golf ball nearest to the golfer) by aligning their eyes until the lower alignment string 108 is perceived by the golfer to be oriented along an axis 202 positioned to the left of axis 200 of the upper alignment string 106 and separated by a perceived separation distance 306. This perceived separation distance 306 provides the golfer eyes with a clear visual cue and baseline training aid for consistently aligning their eyes at the same orientation just inside the golf ball 14 by maintaining that same perceived separation distance 306. In this manner, the golfer can properly and consistently align their putter in perpendicular relation to the putting line.

Figure 9:
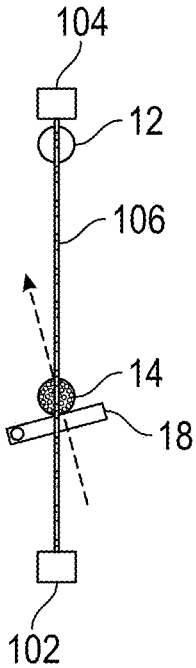
FIG. 9 is an illustration showing the putter oriented to the left of target at address relative to the putting line established by the aligned upper and lower alignment strings in which the upper alignment string covers the lower alignment string.
Figure 10:
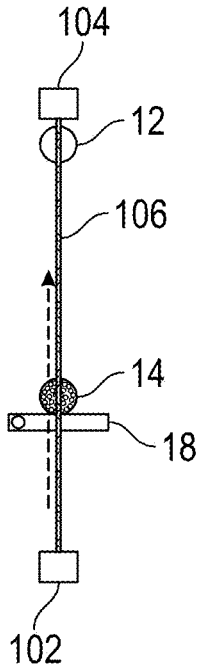
FIG. 10 is an illustration showing the putter oriented to perpendicular to the target at address relative to the putting line established by the aligned upper and lower alignment strings in which the upper alignment string covers the lower alignment string.
Figure 11:
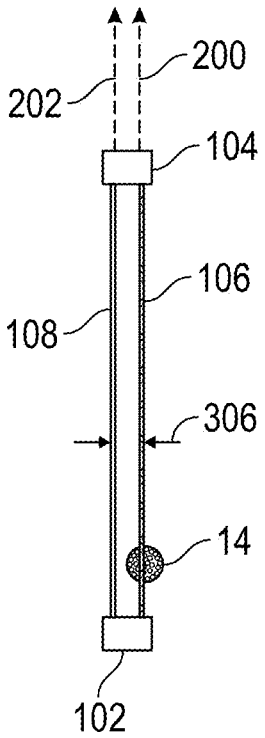
FIG. 11 is an illustration that shows the visual alignment of the upper and lower alignment strings when a golfer properly aligns their eyes just inside the golf ball such that the golfer perceives the lower alignment string being aligned left of the upper alignment string by a perceived separated distance.
Figure 14:
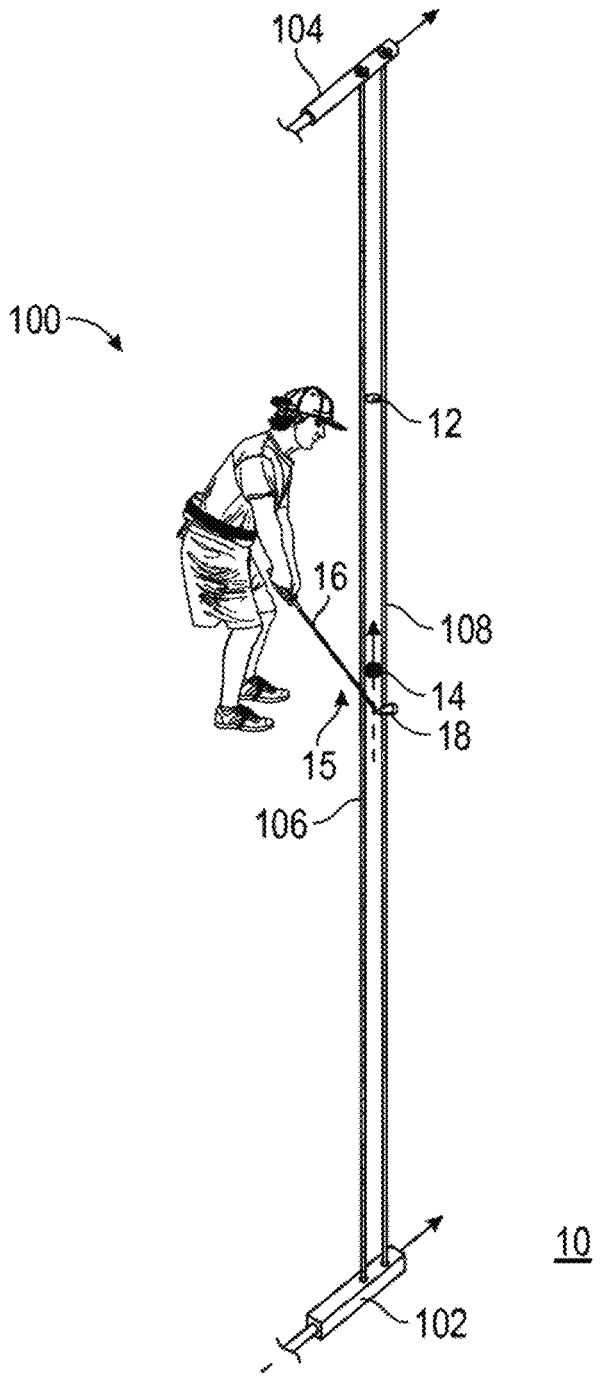
FIG. 14 is an illustration that shows the first and second stakes embedded in the putting surface at a 45 degree angle such that a gap is defined between the upper alignment string and the lower alignment string that forms a pathway for allowing a golfer to keep the putter shaft moving back and forth along a single plane which maintains the correct face path of the putter.

Referring to FIGS. 9 and 14, the golf putting aid apparatus 100 also provides a visual cue to the golfer when the golfer's eyes are improperly aligned outside the golf ball 14 such that the lower alignment string 108 is perceived by the golfer to be oriented along axis 204 to the right of axis 200 of the upper alignment string 106 which can cause the golfer to incorrectly orient their putter either right of the target at address (FIG. 10) or to the left of the target at address (FIG. 11). As such, the lower alignment string 108 being perceived by the golfer's eyes to be on the right of the upper alignment string 106 provides a clear visual cue to the golfer that the golfer's eyes are improperly aligned outside the golf ball 14. To adjust, the golfer realigns their eyes until the lower alignment string 108 is perceived by the golfer to either appear to the left side of the upper alignment string 106 (FIG. 13) at a perceived separation distance 306 or hidden from view by the upper alignment string 106 (FIG. 12).

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A method of golf training comprising:

providing a golf putting aid comprising a first stake and a second stake with an upper alignment string coupled to the first and second stakes and a lower alignment string coupled to the first and second stakes; and embedding the first stake at a first location along a surface area and embedding the second stake at a second location along the surface area such that the upper alignment string is in parallel relation to the lower alignment string that establishes parallel reference lines wherein embedding the first stake at a 45 degree angle relative to the surface area and embedding the second stake at a 45 degree angle relative to the surface area that establishes a degree of tension to the upper and lower alignment strings such that the upper and lower alignment strings are in the parallel relation to each other and a gap is defined between the upper and lower alignment strings wherein the gap is configured to provide a reference line for a shaft of a putter inserted between the first and second alignment strings.

2. The method of golf training of claim 1, comprising:

embedding the first stake at a first position defined along the surface area and embedding the second stake at a second position along the surface area that establishes a degree of tension to the upper and lower alignment strings such that the upper and lower alignment strings are in the parallel relation to each other.

3. The method of golf training of claim 2, wherein the lower alignment string is perceived to be to the left of the upper alignment string when the golfer's eyes are inside of the golf ball.

4. The method of golf training of claim 1, further comprising:

positioning a golf ball directly below the upper alignment string and the lower alignment string.

5. The method of golf training of claim 4, wherein the lower alignment string is perceived to be hidden by the upper alignment string when the golfer's eyes are directly on top of the golf ball.

6. The method of golf training of claim 4, wherein the lower alignment string is perceived to be to the right of the upper alignment string when the golfer's eyes are outside of the golf ball.

7. The method of golf training of claim 1, wherein the first stake at the first position or the second stake at the second position is embedded proximate a hole formed in the surface area.

* * * * *